US005878977A

United States Patent [19]

Hosaka et al.

[11] Patent Number: 5,878,977

[45] Date of Patent: Mar. 9, 1999

[54] OFFSET DETECTION APPARATUS AND FLYING OBJECT GUIDING SYSTEM USING THE APPARATUS

[75] Inventors: Naoki Hosaka, Tokyo; Hajime Honda, Yokohama, both of Japan

[73] Assignee: Kabushiki Kaisha Toshiba, Kawasaki, Japan

[21] Appl. No.: 939,505

[22] Filed: Sep. 29, 1997

[30] Foreign Application Priority Data

Sep. 30, 1996 [JP] Japan ..... 8-259101
Sep. 12, 1997 [JP] Japan ..... 9-249095

[51] Int. Cl.[6] ..... F41G 7/00
[52] U.S. Cl. ..... 244/3.13
[58] Field of Search ..... 244/3.13, 3.11; 356/141.2

[56] References Cited

U.S. PATENT DOCUMENTS

| | | | |
|---|---|---|---|
| 3,513,315 | 5/1970 | Sundstrom et al. | 244/3.13 |
| 4,014,482 | 3/1977 | Esker et al. | 244/3.13 |
| 4,020,339 | 4/1977 | Gustafson | 244/3.13 |
| 4,422,601 | 12/1983 | Chavany et al. | 244/3.13 |
| 4,696,441 | 9/1987 | Jones et al. | 244/3.13 |
| 4,732,349 | 3/1988 | Maurer | 244/3.13 |
| 5,685,504 | 11/1997 | Schneider et al. | 244/3.11 |

FOREIGN PATENT DOCUMENTS

| | | |
|---|---|---|
| 5-45094 | 2/1993 | Japan . |
| 8-178596 | 7/1996 | Japan . |

*Primary Examiner*—Charles T. Jordan
*Assistant Examiner*—Theresa M. Wesson
*Attorney, Agent, or Firm*—Oblon, Spivak, McClelland, Maier & Neustadt, P.C.

[57] ABSTRACT

A light wave guiding apparatus comprising an offset detector for detecting an offset from a predetermined axis is disclosed. A laser beam irradiator irradiates a laser beam having a maximum irradiation intensity in a predetermined orientation and the irradiation intensity decreasing progressively with the increase in the distance away from the orientation while being conically inclined from a predetermined axis. A photo-detector is located in an area irradiated by the laser beam and outputs a received light signal S corresponding to the irradiation intensity. A memory unit stores the relation between the amount of offset of the photo-detector from the predetermined axis and the received light signal S. The received light signal S of the photo-detector is compared with the data stored in the memory unit and the offset amount of the photo-detector is detected.

16 Claims, 13 Drawing Sheets

OFFSET DETECTION APPARATUS AND FLYING OBJECT GUIDING SYSTEM USING THE APPARATUS

BACKGROUND OF THE INVENTION

The present invention relates to an offset detection apparatus for detecting the amount or direction of offset from a predetermined axis, or more in particular to a flying object guiding system for guiding a flying object in a predetermined direction using the offset detection apparatus.

A conventional flying object guiding system comprises a navigation calculator mounted on the flying object for calculating the information such as the attitude angle and the position of the flying object and an external guiding means for transmitting to the flying object by radio the information on the direction of movement on a reference coordinate system (the combined information on the azimuth and elevation or the information on the target position). The flying object calculates the attitude angle and positional information of the flying object using the navigation calculator and determines the direction and amount of steering on the basis of the information on the direction of movement sent from the guiding means.

BRIEF SUMMARY OF THE INVENTION

The conventional flying object guiding system described above shares a coordinate system with the steering system using the attitude angle and the positional information of the flying object obtained from the navigation calculator mounted on the flying object. Specifically, in the case where the guiding system fails to share a coordinate system with the flying object steering system, the flying object cannot fly in the direction conforming with the direction information which may be received from the guiding means. As a result, the guiding system is required to share a coordinate system with the flying object steering system.

The present invention is intended to obviate the above-mentioned disadvantages, and the object thereof is to provide an offset detection apparatus for detecting the amount or direction of offset from a predetermined axial direction even in the absence of a common coordinate system, and a flying object guiding system capable of guiding a flying object in a predetermined direction even in the case where the guiding system and the flying object steering system fail to share a coordinate system.

In order to obviate the above-mentioned problem, according to the present invention, there is provided an offset detection apparatus comprising a laser beam irradiator 11 for irradiating a laser beam having a maximum irradiation intensity in the orientation and also having such a characteristic that the irradiation intensity decreases with the increase in the distance from the orientation, the laser beam being irradiated while being rotated conically with the orientation inclined with respect to a predetermined axis, a photo-detector located in an area irradiated by the laser beam from the laser beam irradiator for receiving the laser beam and outputting a received-light signal corresponding to the irradiation intensity, a memory means for producing data on the relation between the offset amount of the photo-detector with respect to the center axis of conical scanning of the laser beam and the light-receiving signal corresponding to the offset amount and storing the data, and an offset amount detector for comparing the received light signal from the photo-detector with the data A stored in the memory means and detecting the offset amount of the photo-detector with respect to the center axis of conical scanning of the laser beam.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out in the appended claims.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described below with reference to the accompanying drawings.

Figure 1A:
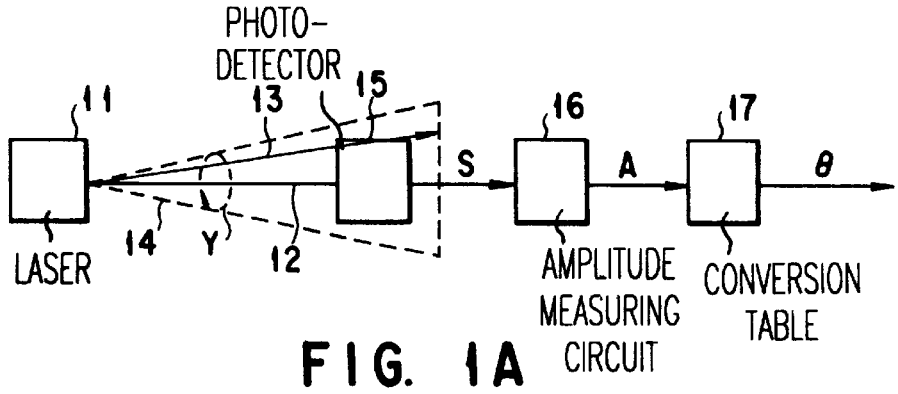
FIGS. 1A to 1F are diagrams for explaining an offset detection apparatus according to an embodiment of the present invention.

FIG. 1A shows a circuit configuration of an offset detection apparatus according to the present invention. In FIG. 1A, reference numeral 11 designates a laser beam irradiator for irradiating a laser beam 13 in conical form about a predetermined axis 12 thereby to form an irradiated area 14 indicated by dotted line. A photo-detector 15 is arranged at the distance of R from the laser beam irradiator 11. The photo-detector 15 receives the laser beam 13 and converts the received light energy into a voltage signal or the like received light signal S and outputs it.

The received light signal S output from the photo-detector 15 is applied to an amplitude measuring circuit 16. The amplitude measuring circuit 16 is for measuring the amplitude change A of the received light signal S. The data on the amplitude change A of the received light signal S measured at the amplitude measuring circuit 16 is applied to a conversion table 17. The conversion table 17 compares the input data with data stored therein and thus detects what is called an offset amount which is an offset angle θ with respect to the center axis 12 of the laser beam 13 on the light receiving surface of the photo-detector 15.

Now, the operation of an offset detection apparatus having the above-mentioned configuration will be explained.

Figure 1C:
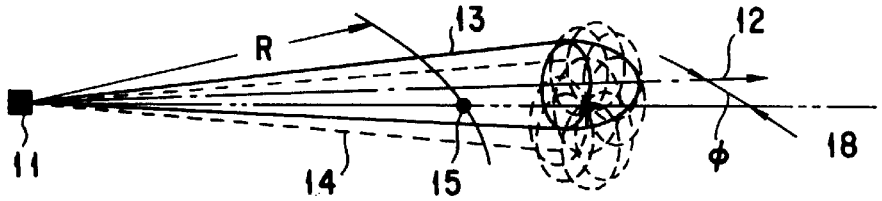
Figure 1B:
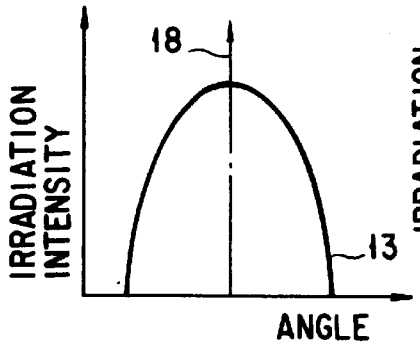

First, the laser beam 13 emitted from the laser beam irradiator 11 has a maximum irradiation intensity in the orientation 18 of the beam as shown in FIG. 1B. With the increase in the distance (offset) from the orientation 18 of the beam, the irradiation intensity is attenuated monotonically. The laser beam 13 having this characteristic rotates about the center axis 12 with the beam orientation 18 inclined by an eccentric angle ϕ with respect to the predetermined center axis 12 thereby to form a laser beam irradiated area 14 as shown in FIG. 1C.

Figure 1D:
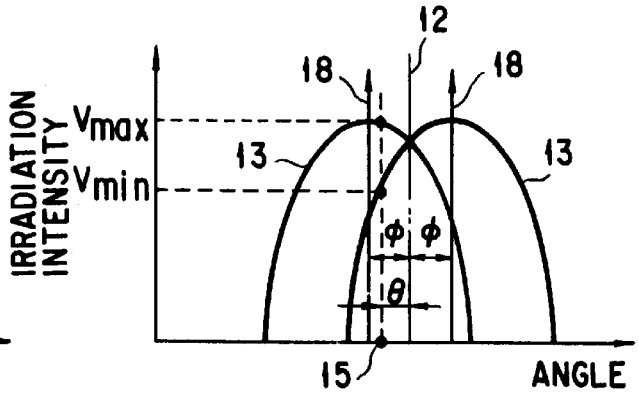

As a result, the trace of the orientation 18 of the laser beam 13 is conical in shape. Within the trace formed by the orientation 18, the beam irradiation intensity is maximum for the orientation 18 as shown in FIG. 1D and monotonically decreases toward the center axis 12.

Figure 1E:
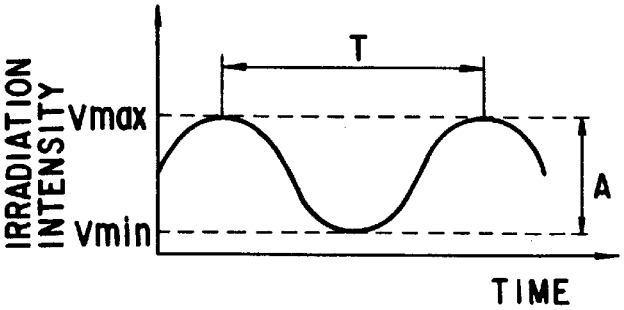

The received light signal S output from the photo-detector 15 located in the laser beam irradiated area 14 changes in the same period T as the rotative period of the laser beam 13 as shown in FIG. 1E. Let the amount of offset from the center axis be expressed as the offset angle θ, and the amplitude change of the difference between maximum and minimum values of the received light signal S output from the photo-detector 15 be expressed as A. Then, in the case where the offset angle θ is zero, the amplitude change A is zero and a direct current results. With the increase in the offset angle θ, the amplitude change A also increases. The received light signal S thus forms what is called an amplitude-modulated signal.

In this case, assume that the maximum value of the irradiation intensity is Vmax and the minimum value thereof Vmin. The amplitude change A is given as $$A=Vmax-Vmin \tag{1}$$

Figure 1F:
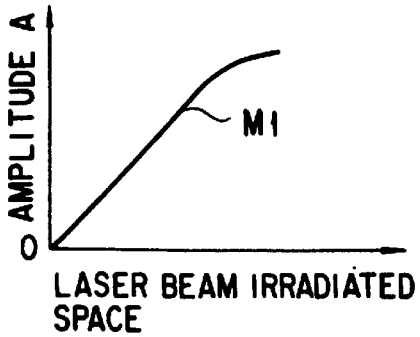

This relation shows that the amplitude modulated signal has such a characteristic that the amplitude change A monotonically increases with the offset angle θ as indicated by a line segment M in the graph of FIG. 1F, where the ordinate represents the amplitude change A and the abscissa the offset angle θ.

The characteristic of the amplitude-modulated signal as indicated by the line segment M of FIG. 1F, i.e., the relation between the amplitude change A and the offset angle θ is converted into a function or a table and stored in the conversion table 17. As a result, the offset angle θ corresponding to the amplitude change A can be determined by entering in the conversion table 17 the amplitude change A of the received light signal measured in the amplitude measuring circuit 16.

Figure 2A:
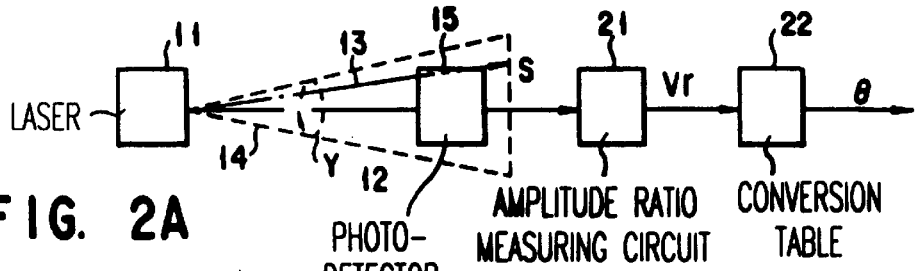
FIGS. 2A and 2B are diagrams for explaining an offset detection apparatus according to another embodiment of the present invention.

In the case where the distance R from the laser beam irradiator 11 to the light-receiving surface of the photo-detector 15 is not known in the above-mentioned configuration, it is necessary to add means for measuring the distance R and means for correcting the amplitude modulation characteristic in accordance with the distance R. Now, an offset detection apparatus according to another embodiment of the present invention will be explained with reference to the circuit configuration diagram of FIG. 2A and the characteristic diagram of FIG. 2B. In FIG. 2A, those component parts identical to the corresponding parts in FIG. 1A are denoted by the same reference numerals, respectively, and will not be described any further.

The received light signal S output from the photo-detector 15 is applied to the amplitude measuring circuit 16 in FIG. 1A, whereas it is applied to an amplitude ratio measuring circuit 21 in FIG. 2A. This amplitude ratio measuring circuit 21 is for determining the amplitude ratio Vr between the maximum value Vmax and the minimum value Vmin of the amplitude of the received light signal S.

Figure 2B:
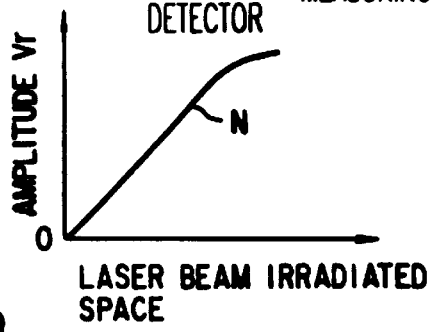

In the present embodiment, the conversion table 22 has stored therein such data that the offset angle θ with respect to the center axis 12 of the photo-detector 15 is output in response to the amplitude ratio Vr, for example, the data representing the relation as indicated by the line segment N in FIG. 2B. In FIG. 2B, the ordinate represents the ratio Vr between maximum and minimum values of the amplitude of the received light signal S output from the photo-detector 15, and the abscissa represents the offset angle θ of the photo-detector 15 with respect to the center axis 12.

Specifically, the offset detection apparatus according to this embodiment, which uses the amplitude ratio measuring circuit 21, can determine the correct value of the offset angle θ even when the conversion efficiency of the photo-detector 15 undergoes a change.

When the conversion efficiency of the photo-detector 15 changes by a factor of g, for example, the amplitude value of the received light signal S increased by a factor of g in all. As a result, both the maximum value Vmax and the minimum value Vmin also increase by a factor of g. The ratio Vr between maximum value Vmax and minimum value Vmin, however, is given as $$Vr=(Vmax\times g)/(Vmin\times g)=Vmax/Vmin \tag{2}$$

This indicates that the effect of the change in conversion efficiency is eliminated.

Figure 3B:
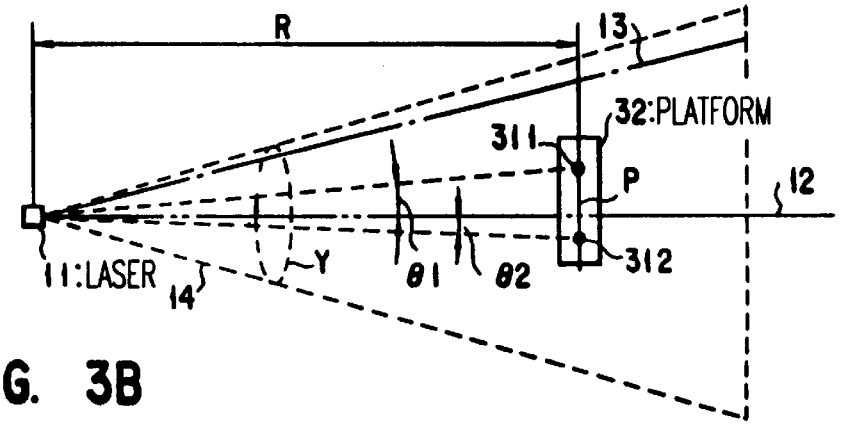
FIGS. 3A and 3B are diagrams for explaining an offset detection apparatus according to still another embodiment of the present invention.
Figure 3A:
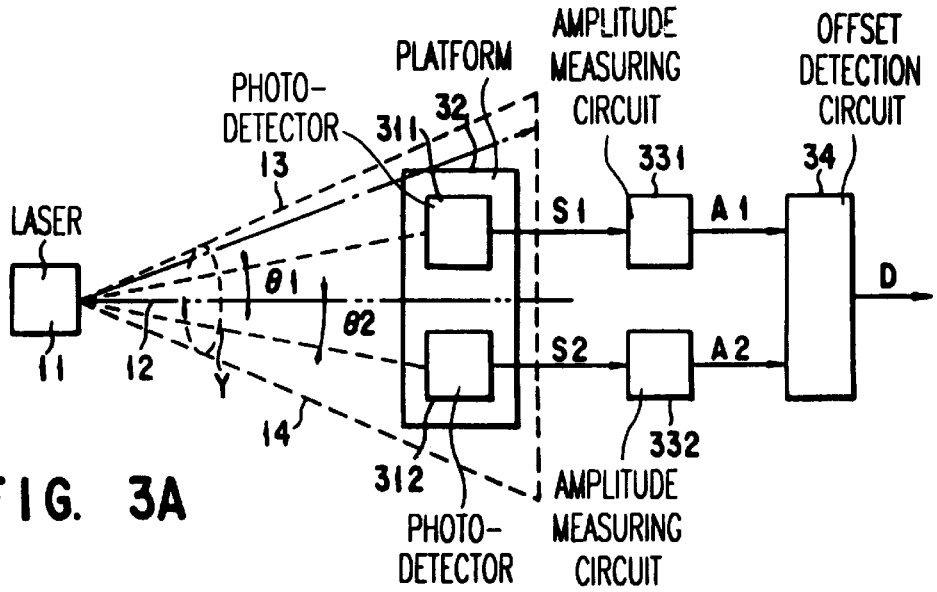

The offset detection apparatus configured as described above thus can determine the offset angle θ of the photo-detector 15 with respect to the center axis 12 without being affected by the change in the conversion efficiency of the photo-detector 15. Also, even when the distance R between the laser beam irradiator 11 and the photo-detector 15 undergoes a change or even when the laser beam 13 changes in level, these changes have no effect on the offset angle θ of the photo-detector 15 with respect to the center axis 12. Now, an explanation will be given of an offset detection apparatus comprising two photo-detectors according to another embodiment of the invention with reference to the circuit configuration diagram of FIG. 3A and the model diagram of FIG. 3B. In FIG. 3A, the component parts identical to the corresponding ones in FIG. 1A are designated by the same reference numerals, respectively, and the description below will be made mainly about the part of the configuration different from FIG. 1A.

In this embodiment, two photo-detectors 311, 312 are installed at such a predetermined spatial interval from each other on a platform 32 that the straight line connecting the two photo-detectors 311, 312 crosses the center axis at right angles at the distance of R from the laser beam irradiator 11. FIG. 3B shows the relation between the arrangement of the laser beam irradiator 11 and the photo-detectors 311, 312 and the irradiated area 14 of the laser beam 13. In FIG. 3B, a point P represents a middle point between the photo-detectors 311 and 312 on the platform 32.

In this configuration, the distribution of the irradiation intensity of the laser beam 13 in the irradiated area 14 is similar to that in FIG. 1D. The received light signals S1, S2 output from the photo-detectors 311, 312 constitute amplitude modulated signals having the amplitude changes A1, A2 determined by the offset angles θ 1, θ 2, respectively, with respect to the center axis 12. The received light signals S1, S2 are applied to amplitude measuring circuits 331, 332, respectively, thereby to measure amplitude changes A1, A2. After that, the amplitude changes A1, A2 are compared in an offset detection circuit 34, thus detecting the direction in which the platform 33 and the photo-detectors 311, 312 are offset, for example, the direction in which the middle point P is offset from the center axis 12.

In the case where the middle point P is located on the center axis 12, for example, the amplitude changes A1, A2 of the received light signals S1, S2 output from the photo-detectors 311, 312, respectively, are equal to each other. Once the middle point P is offset toward the photo-detector 311 as shown in FIG. 3B, the photo-detector 311 has a larger displacement from the center axis 12. As a consequence, the amplitude change A1 of the received light signal S1 output from the photo-detector 311 becomes larger. In the case where the middle point P is offset toward the photo-detector 312, in contrast, the amplitude change A2 of the received light signal S2 output from the photo-detector 312 increases relatively. The offset direction is detected by taking advantage of this relation.

Assume, for example, that the amplitude change A1 equals the amplitude change A2 and that the middle point P thus is located on the center axis 12. In such a case, the offset detection circuit 34 judges that "there is no offset", and outputs an offset direction signal D of "0". In the case where A1 is larger than A2, on the other hand, it indicates that the middle point P is seen to offset toward the photo-detector 311. In such a case, the judgement is that "there is an offset", so that an offset direction signal D of "+1" is output. If A1 is smaller than A2, in contrast, the middle point P is offset toward the position where the photo-detector 312 is arranged. In such a case, the offset detection circuit 34 judges that "there is an offset", and outputs the offset direction signal D of "−1", for example.

The above-mentioned method can measure the direction in which the platform 32 or the photo-detectors 311, 312 are offset from the center axis 12.

In the configuration of FIG. 3A, the offset amount can be determined by using a conversion table (not shown) showing the relation between the amplitude changes A1, A2 of the received signals S1, S2 and the offset angle θ in terms of functions as described with reference to FIG. 1A.

Also, the distances between the laser beam irradiator 11 and the photo-detectors 311, 312 are strictly different. The change in the irradiation intensity due to this distance difference is negligibly small and poses no practical problem.

Figure 4A:
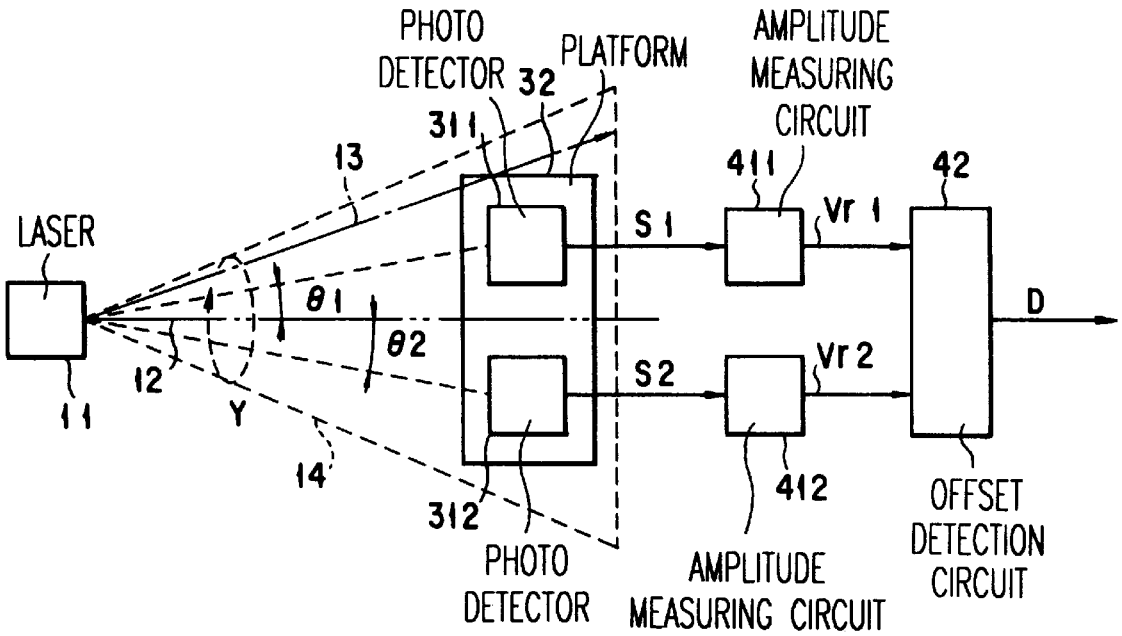
FIGS. 4A and 4B are diagrams for explaining an offset detection apparatus according to a further embodiment of the present invention.
Figure 4B:
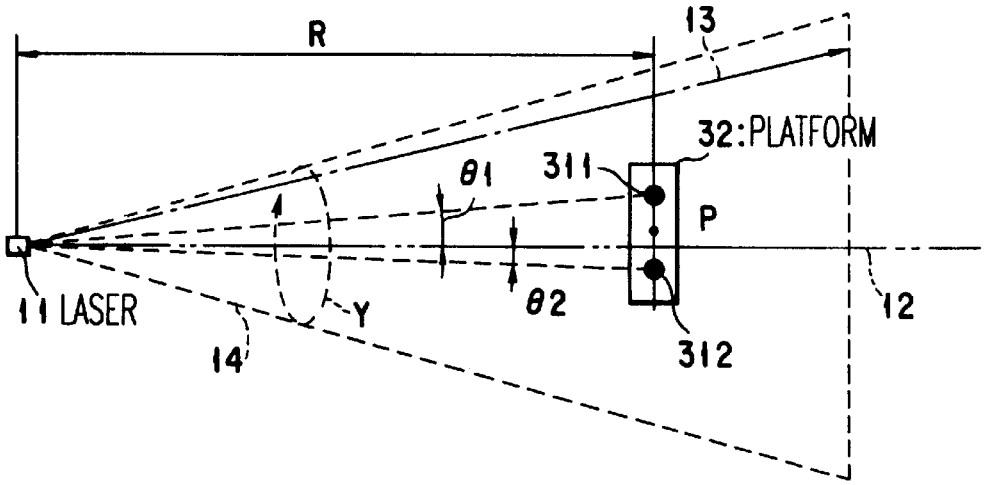

Now, an offset detection apparatus according to another embodiment of the invention will be explained with reference to FIGS. 4A to 4B. In FIG. 4A, the component parts identical to the corresponding ones in FIG. 3A are designated by the same reference numerals, respectively, and the description that follows will be made mainly about the configuration different from FIG. 3A. Also, FIG. 4B, like FIG. 3B, shows the relation between the arrangement of the laser beam irradiator 11 and the photo-detectors 311, 312 and the irradiated area 14 of the laser beam 13.

According to this embodiment, the system includes amplitude ratio measuring circuits 411, 412 in place of the amplitude measuring circuits 331, 332 of FIG. 3A. The received light signals S1, S2 output from the photo-detectors 311, 312 are applied to the amplitude ratio measuring circuits 411, 412, respectively, thereby to calculate the amplitude ratios Vr1, Vr2 between the maximum value Vmax and the minimum value Vmin of the respective amplitudes.

The use of the amplitude ratio can determine the correct offset direction even if the conversion efficiencies of the photo-detectors 311, 312 are different from each other. Assuming that the conversion efficiency of the photo-detector 311 is larger by a factor of g than that of the photo-detector 312, for example, the amplitude value of the received light signal of the photo-detector 311 is larger by a factor of g in all, so that the maximum value Vmax and the minimum value Vmin also increase by a factor of g, respectively. The ratio Vr between the two is not affected by the difference in conversion efficiency as seen from the relation of (2).

Further, in the configuration shown in FIG. 4A, the magnitudes of the amplitude ratio Vr1 and the amplitude ratio Vr2 are compared with each other in the offset detection circuit 42. In the case where Vr1 equals Vr2, the offset detection circuit 42 judges that the offset direction of the platform 32 and the photo-detectors 311, 312, i.e., the position of the middle point P with respect to the center axis 12 is "not offset", and outputs an offset direction signal D of "0", for example. In the case where Vr1 is larger than Vr2, on the other hand, the judgement is that "there is an offset toward the photo-detector 311", and an offset direction signal D of "+1" is output, for example. When Vr1 is smaller than Vr2, in contrast, the offset detection circuit 42 judges that "there is an offset toward the photo-detector 312", and outputs an offset direction signal D of "−1", for example.

Also in the configuration of FIG. 4A, the offset amount is determined using a conversion table (not shown) showing the relation between the ratio between the maximum amplitude and the minimum amplitude of the received light signals S1, S2 in terms of functions.

The configuration shown in FIG. 4A, on the other hand, can determine the offset angles θ 1, θ 2 of the photo-detectors 311, 312 with respect to the center axis 12 without regard to the change in the irradiation intensity due to the fluctuations of the output level of the laser beam irradiator 11 or the change in the distance R from the laser beam irradiator 11.

Figure 5A:
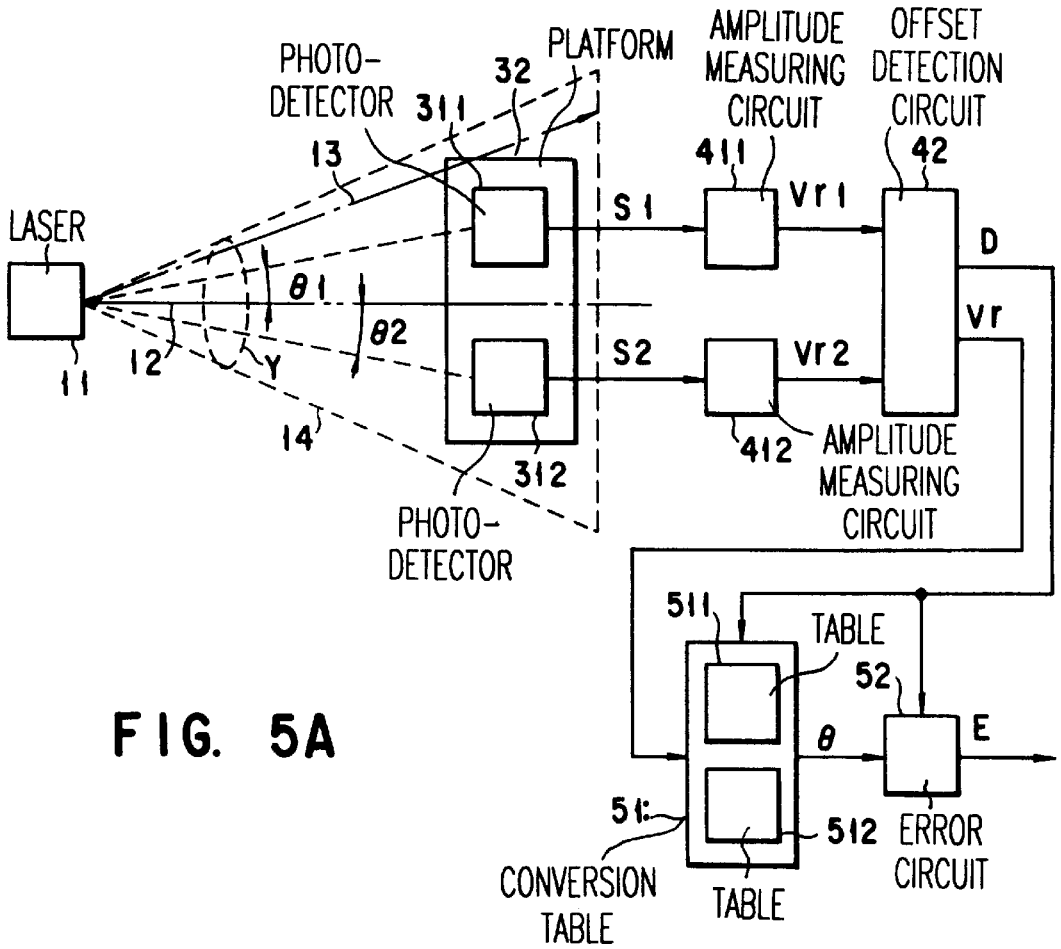
FIGS. 5A and 5B are diagrams for explaining an offset detection apparatus according to a still further embodiment of the present invention.
Figure 5B:
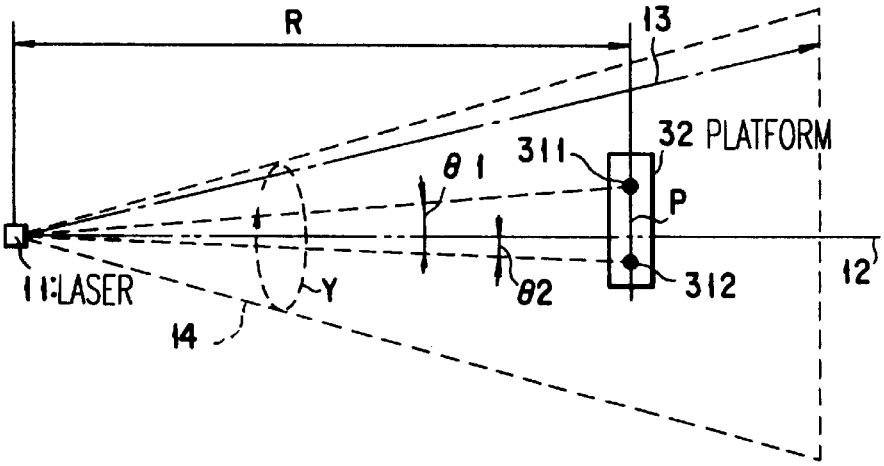

Now, an offset detection apparatus according to still another embodiment of the invention will be explained with reference to FIGS. 5A and 5B. In FIG. 5A, the component parts identical to the corresponding ones in FIG. 4A are designated by the same reference numerals, respectively, and the description below will be given mainly of the configuration different from FIG. 4A. FIG. 5B shows the relation between the arrangement of the laser beam irradiator 11 and the photo-detectors 311, 312 and the irradiated area 14 of the laser beam 13.

According to this embodiment, the two photo-detectors 311, 312 are arranged at a predetermined spatial interval on the platform 32 in such a manner that the straight line connecting them to each other is perpendicular to the center axis 12 at the distance R from the laser beam irradiator 11. FIG. 5B shows the relation between the arrangement of the laser beam irradiator 11 and the photo-detectors 311, 312 and the irradiated area 14 of the laser beam 13. In FIG. 5B, the point P represents a middle point between the photo-detectors 311, 312 on the platform 32.

With the above-mentioned configuration, the received light signals S1, S2 output from the photo-detectors 311, 312 are applied to amplitude ratio measuring circuits 411, 412 for determining amplitude ratios Vr1, Vr2, respectively. After that, the amplitude ratios Vr1 and Vr2 are compared in magnitude with each other at the offset detection circuit 42.

In the process, assuming that Vr1 equals Vr2, the offset detection circuit 42 judges that the position of the platform 32 and the photo-detectors 311, 312, i.e., the position of the middle point P is "not offset" with respect to the center axis 12, and outputs an offset direction signal D of "0", for example. In the case where Vr1 is larger than Vr2, on the other hand, the judgement is that "there is an offset toward the photo-detector 311", and an offset direction signal D of "+1" is produced, for example. Also, when Vr1 is smaller than Vr2, the judgement is that "there is an offset toward the photo-detector 312", so that an offset direction signal D of "−1" is output, for example.

The offset detection circuit 42 selects Vr1 or Vr2, whichever is larger, and outputs the larger one of them as an amplitude ratio signal Vr. Assume that Vr1 is larger than Vr2 and Vr equals Vr1. Then, the amplitude ratio Vr1 is entered in the conversion table 51 as the amplitude ratio signal Vr. The conversion table 51 is configured of two conversion tables 511, 512. Since the amplitude ratio Vr1 is applied as an input, the conversion table 511 corresponding to the output of the photo-detector 311 is selected by the offset direction signal D. The conversion table 511 has stored therein the relation between the offset angle θ of the photo-detector 311 and the amplitude ratio Vr1, so that the offset angle θ of the photo-detector 311 from the center axis 12 can be determined using the amplitude ratio Vr1.

The offset direction signal D determined in the amplitude ratio comparator circuit 42 and the offset angle θ determined from the conversion table 51 are applied to an error signal calculation circuit 52, thereby producing an error signal containing the offset signal of the photo-detector 311, i.e., what is called an error signal E containing the data on the offset direction and the offset amount.

In this case, the error signal E is expressed as an offset value with a sign from the offset direction D and the offset angle θ, as follows.

$$E=D\times\theta \tag{3}$$

where D=0, when Vr1=Vr2, D=+1 when Vr1>Vr2, and D=−1 when Vr1<Vr2.

In the case where the offset detection circuit 42 selects the smaller amplitude ratio, the sign of equation (3) is undesirably reversed between when the offset amount is small and the two photo-detectors 311, 312 are located on opposite sides of the center axis and when the offset amount is large and both the photo-detectors 311, 312 are on the same side of the center axis 12.

Now, a flying object guiding system according to an embodiment of the present invention will be explained with reference to FIGS. 6A, 6B, 6C.

Figure 6A:
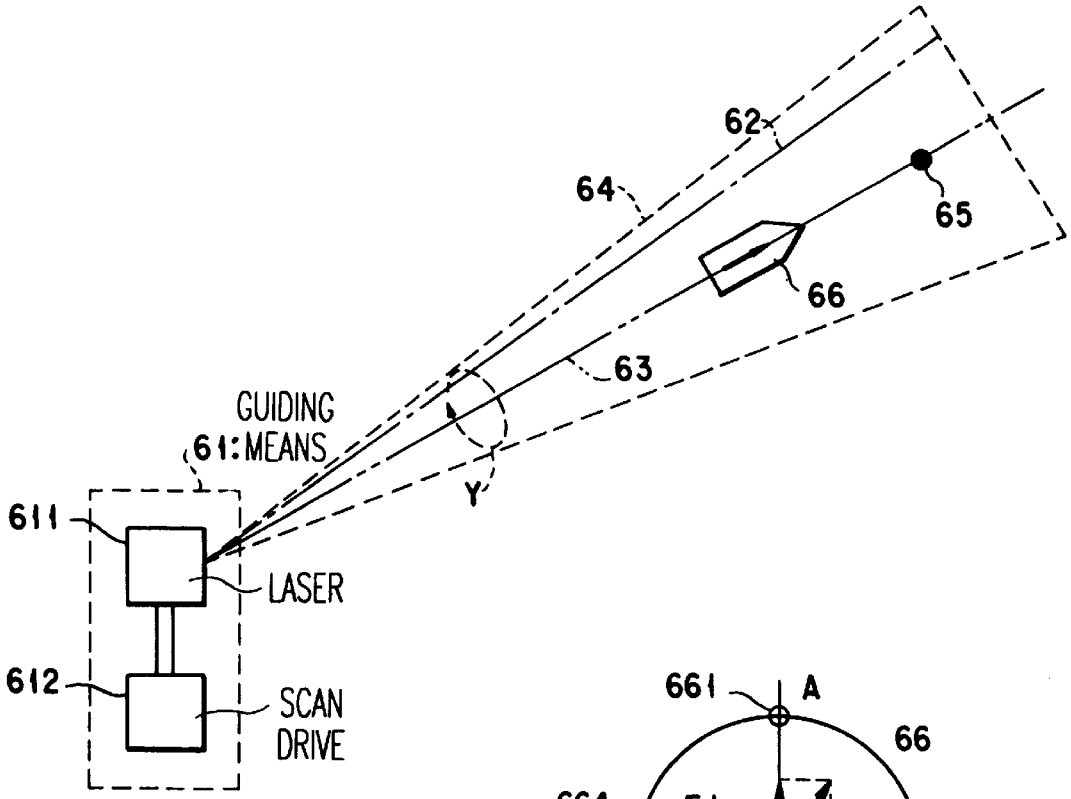
FIGS. 6A to 6C are diagrams for explaining a light wave guiding system according to an embodiment of the invention.

In FIG. 6A, reference numeral 61 designates a guiding means installed in a launching base or on an airplane carrying the flying object. The guiding means includes a laser beam irradiator 611 and a scanning drive unit 612.

The laser beam irradiator 611, which has a similar configuration to the offset detection apparatus described with reference to FIG. 1B, irradiates the laser beam 62 conically while rotating in the direction of arrow Y about an axis 63, and forms an irradiated area 64 similar to the one described with reference to FIGS. 1C and 1D.

The scanning drive unit 612 is for controlling the direction of a rotative axis 63 with respect to the laser beam irradiator 6111. For example, the center axis 63 of the irradiated area 64 is controlled toward a target 65, or a flying object 66 proceeding toward the target 65 is controlled to be located within the irradiated area 64.

Figure 6B:
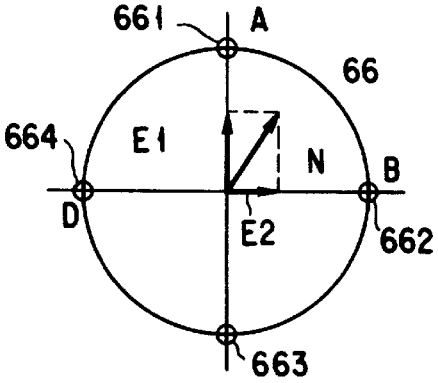

The flying object 66 has arranged thereon, as shown by points A to D in FIG. 6B, four photo-detectors 661, 662, 663, 664 equidistantly from each other along a common circumference on the body surface thereof, for example, and contains therein a steering control unit operated based on the offset detection.

Figure 6C:
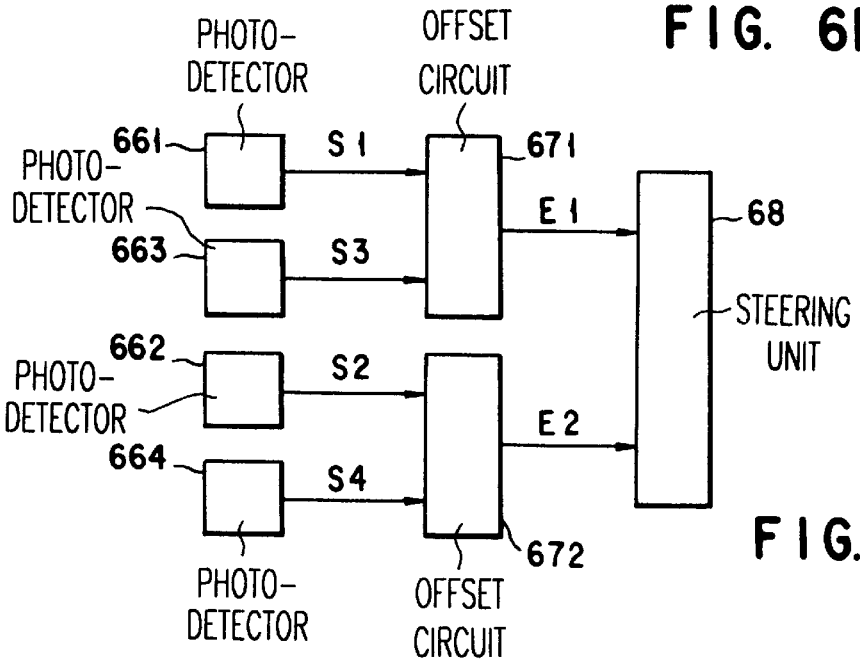

In respect of this configuration, a method of producing error signals E1, E2 and a steering vector N from the photo-detectors 661, 662, 663, 664 will be explained with reference to FIG. 6B showing relative positions of the photo-detectors and FIG. 6C showing a configuration of the steering control unit mounted on the flying object.

In the flying object 66, the steering control unit applies the received light signals S1, S3 output from the photo-detector 661 at point A and the photo-detector 663 at point C to an offset detection circuit 671, and processes them in the same manner as described in the embodiments of the offset detection apparatus described above, thus producing the offset direction and the offset amount in the direction of the line segment AC, i.e., an offset signal E1. In similar fashion, the received light signals S2, S4 of the photo-detector 662 at point B and the photo-detector 664 at point D are applied to the offset detection circuit 672 and an offset signal E2 is output in the direction of the line segment B-D.

These offset signals E1, E2 are applied to a steering unit 68. The steering unit 68 calculates a steering vector N with respect to the center axis 64 based on the offset signals E1, E2. The flying object 66 thus is steered to minimize the steering vector N and controlled to proceed along the center axis 64.

In the above-mentioned configuration, the flying object 66 flies toward a target 65. In the case where the direction in which the flying object 66 proceeds (indicated by arrow in FIG. 6A) offsets from the center axis 63, the offset signals E1, E2 both are generated as an error. Each time the error signals are generated, an the direction in which the flying object 66 proceeds is corrected to reduce the offset signals E1, E2 to zero. In this way, the flying object 66 can be guided toward the target 65.

Figure 7:
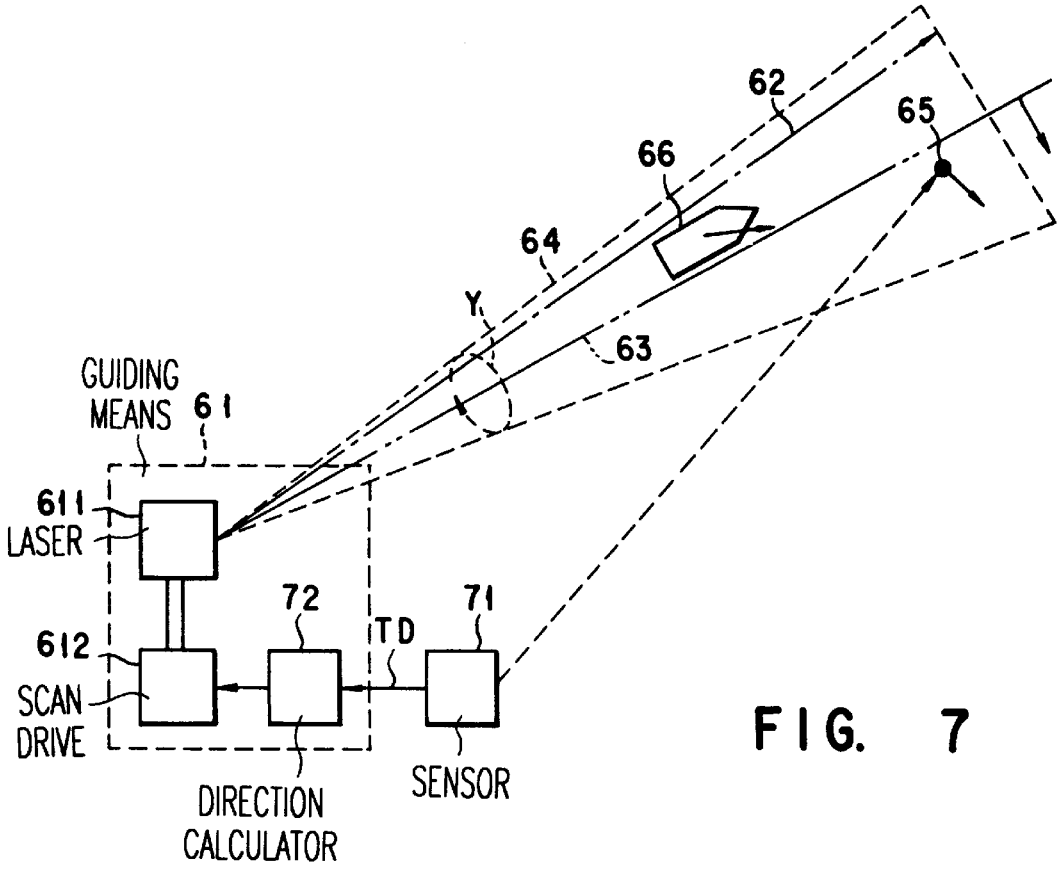
FIG. 7 is a diagram for explaining a light wave guiding system according to another embodiment of the invention.

Now, a flying object guiding system according to another embodiment of the invention will be explained with reference to FIG. 7. In FIG. 7, the component parts identical to the corresponding ones of FIG. 6A are designated by the same reference numerals, respectively, and the description that follows will be limited to the configuration different from FIG. 6A.

In this embodiment, a target setting sensor 71 is installed in the flying object launching base or on the airplane carrying the flying object. The position or speed of the target 65 or the like target information TD are detected by the sensor 71. The target information TD thus detected is applied to an irradiation direction calculator 72. This irradiation direction calculator 72 calculates a future position of the target 65, for example, on the basis of the target information TD and applies the future position data thus calculated to the scanning drive unit 612. As a result, the scanning drive unit 612 drives the laser beam irradiator 611 in such a manner that the center axis of the irradiated area 64 coincides with the future position of the target 65, for example.

In this configuration, the center axis 63 is directed always toward the target 65. The flying object 66 is guided along the center axis 63 toward the target 65. The method of guiding the flying object is similar to the one explained in the embodiment of FIG. 6A and will not be explained any further.

Figure 8:
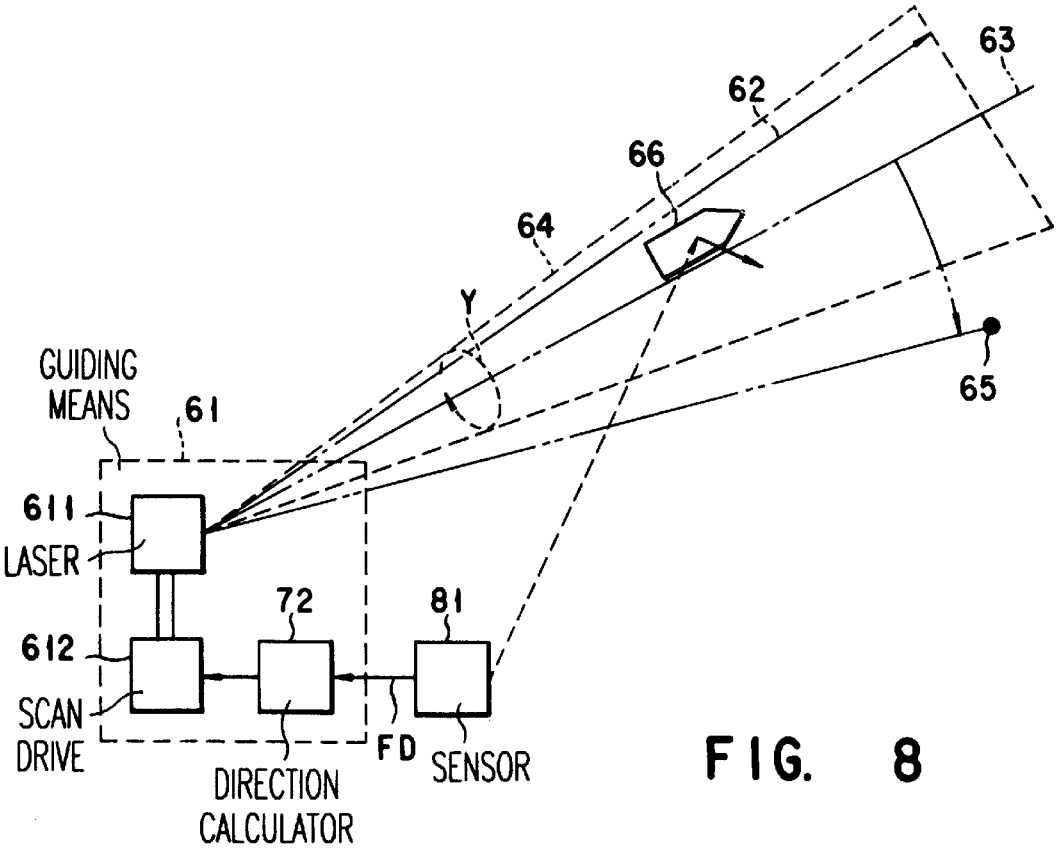
FIG. 8 is a diagram for explaining a light wave guiding system according to still another embodiment of the invention.

Now, a flying object guiding system according to still another embodiment of the invention will be explained with reference to FIG. 8. In FIG. 8, the component parts identical to the corresponding ones in FIG. 7 are designated by the same reference numerals, respectively, and the description that follows will be limited to the configuration different from FIG. 7.

In this embodiment, a flying object setting sensor 81 for detecting the positional information FD of the flying object 66 is arranged in the flying object launching base or on the airplane carrying the flying object. The sensor 81 detects the positional information FD of the flying object 66, which positional information FD is applied to the irradiation direction calculator 72. In the process, the irradiation direction calculator 72 calculates the laser beam orientation in such a manner that the center axis 63 of the irradiated area 64 is located at the middle point between the positional information FD and the target 65 of the flying object 66 and that the flying object 66 is included in the irradiated area 64. The result of this calculation is transmitted to the scanning drive unit 612 so that the laser beam irradiated from the laser beam irradiator 611 is controlled to proceed in the calculated orientation.

In this case, the flying object 66 is guided gradually toward the center axis 63, so that the flying object 66 and the target 65 enter the same irradiated area. Thus, the flying object 66 is guided toward the target 66 in the same manner as described with reference to FIG. 7.

With this configuration, the positional information FD of the flying object 66 is detected and the orientation of the laser beam is controlled in such a manner that the flying object is included in the irradiated area 64. The embodiment therefore is effectively applicable to the guiding operation in the case where the flying object 66 is displaced from the irradiated area 64 of the laser beam.

Figure 9:
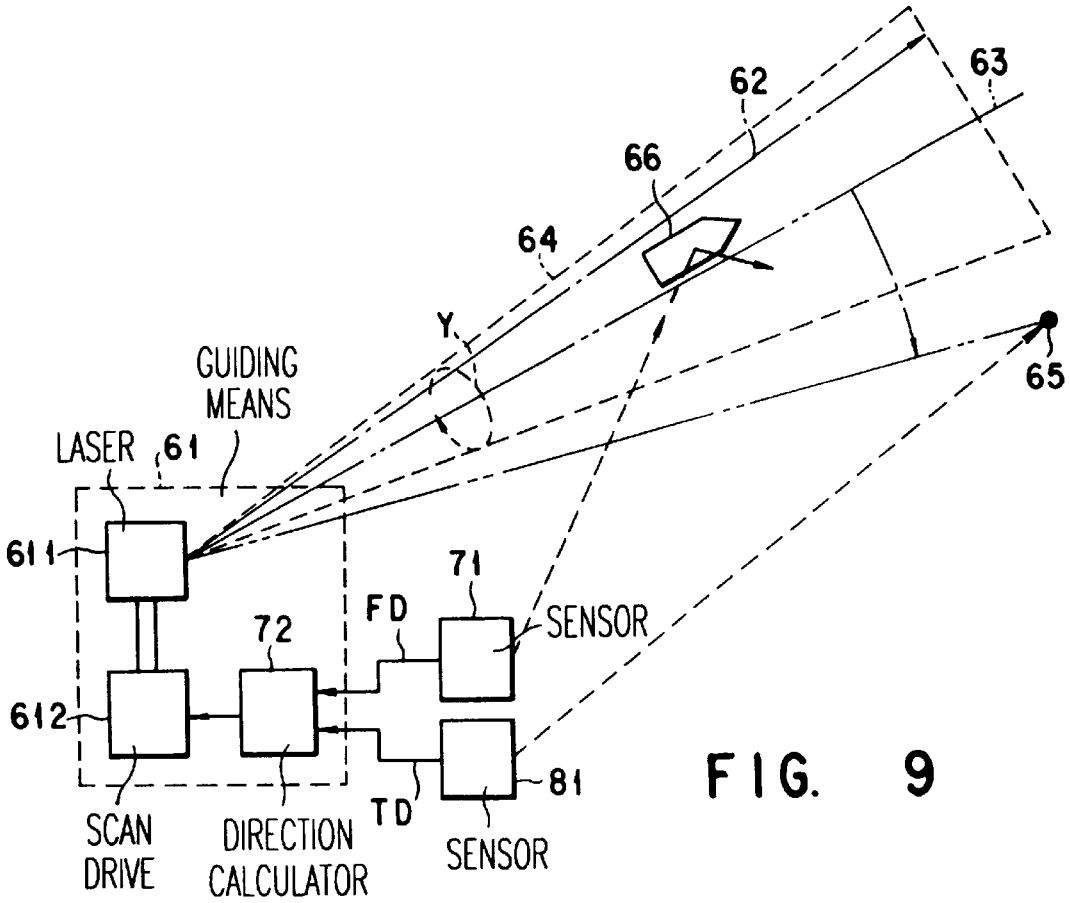
FIG. 9 is a diagram for explaining a light wave guiding system according to a further embodiment of the invention.

Now, a flying object guiding system according to a further embodiment of the invention will be explained with reference to FIG. 9. In FIG. 9, the component parts identical to the corresponding ones in FIG. 8 are designated by the same reference numerals, respectively, and the description that follows will be limited to the configuration different from FIG. 8.

According to this embodiment, both a target setting sensor 71 for observing the target 65 and a flying object setting sensor 81 for observing the flying object 66 are arranged in a flying object launching base or on an airplane carrying the flying object. The positional information TD of the flying object obtained from the flying object setting sensor 81 and the target positional information FD obtained from the target setting sensor 71 are applied to the irradiation direction calculator 72. As a result, the irradiation direction calculator 72 calculates the direction of the center axis 63 in such a manner that the center axis 63 of the irradiated area 64 is located at the middle point between the position of the flying object 66 and the target 65 and then in such a manner that the flying object 66 is included in the irradiated area 64. The result of this calculation is transmitted to the scanning drive unit 612, so that the center axis 63 of the laser beam irradiator 611 is oriented in the calculated direction.

In this configuration, the flying object 66 located within the irradiated area 64 is controlled toward the center axis 63. After that, the flying object 66 continues to fly in such a manner as to approach the center axis 63 until the target 65 and the flying object 66 enter the same irradiated area. Once the center axis 63 is oriented toward the target 65, the flying object 66 flies toward the target 65 and is guided in the direction toward the target.

Each of the above-mentioned embodiments refers to the case in which the laser beam is a continuous wave. The present invention is applicable, however, also to the case in which the laser beam is pulse modulated by providing the photo-detector with a circuit for detecting the average value or the wave crest value of the pulses.

An example in which the laser beam is pulse modulated will be explained with reference to FIGS. 10A and 10B.

Figure 10A:
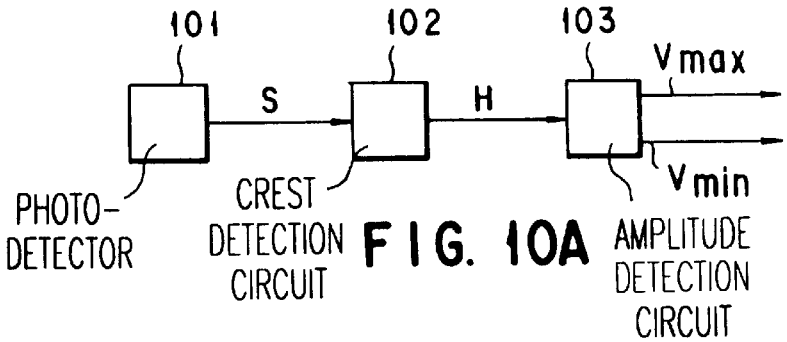
FIGS. 10A and 10B are diagrams for explaining light wave guiding systems according to other embodiments of the invention.
Figure 10B:
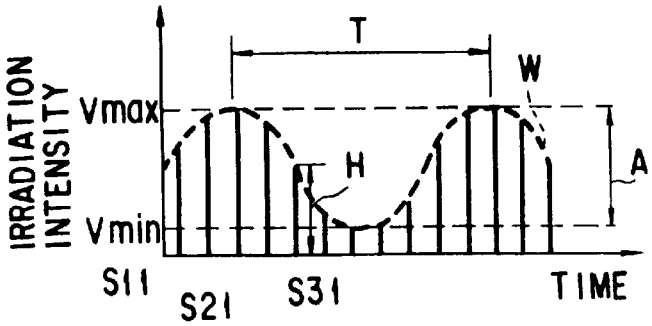

FIG. 10A shows a configuration of a steering control unit mounted on the flying object. Numeral 101 designates a photo-detector. In this case, the waveform of the received light signal S output from the photo-detector 101 assumes a pulse form as shown in FIG. 10B (outputs S11, S21, S31 and so on). At the same time, the envelope waveform W of the pulse-like output of the received light signal S is equivalent to the one shown in FIG. 1E changing in the period T. The crest value H of each pulse-like output S11, S12, S13 and so on is detected, for example, by a pulse wave crest detection circuit 102, and the maximum value Vmax and the minimum value Vmin of the envelope waveform W is calculated from the crest value H are calculated by an amplitude detection circuit 103 thereby to determine an amplitude change A. Using the maximum value Vmax and the minimum value Vmin detected this way, the offset direction and the offset amount can be detected and the guiding operation with a light wave can be performed in the same manner as with the continuous wave.

When the maximum value Vmax and the minimum value Vmin of the envelope waveform W are calculated in the amplitude detection circuit 103, the maximum value or the minimum value of the pulse crest can be approximated to Vmax and Vmin, respectively, if the pulse train is sufficiently high in density.

Figure 11A:
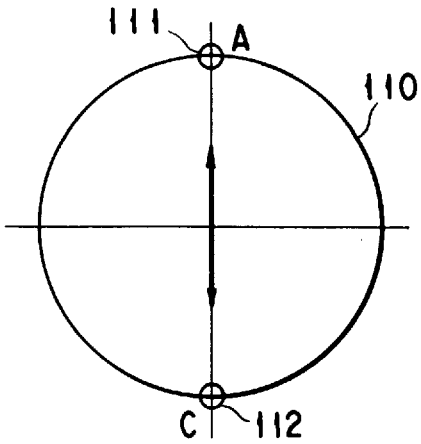
FIGS. 11A to 11E are diagrams for explaining the operation of the invention having photo-detectors in the number other than four.
Figure 11B:
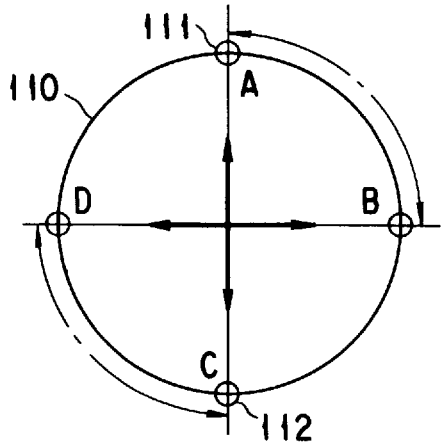

The flying object guiding system described above employs four photo-detectors. The invention, however, can be configured of a plurality of photo-detectors in a number other than four. The case in which the photo-detectors are not four in number, for example, will be explained with reference to FIGS. 11A to 11E. FIG. 11A shows the case in which photo-detectors 111, 112 are arranged at points A and C, respectively, 180° apart from each other. In this case, only an offset signal E along a single axis indicated by arrow in FIG. 11A is obtained from the two photo-detectors 111, 112. As shown in FIG. 11B, however, two states can be realized, one in which the two photo-detectors 111, 112 are located at points A and C, respectively, and the other in which the two photo-detectors 111, 112 are located at points B and D, respectively, by rotating the photo-detectors 111, 112 by 90° around the body 110 of the flying object.

Thus, offset signals E1, E2 in two directions (corresponding to the error signal for the flying object guiding system) can be produced by providing a time lag between the state in which the photo-detectors 111, 112 are located at points A and C, respectively, and the state in which the photo-detectors 111, 112 are located at points B and D, respectively. It is thus possible to calculate the steering vector N. The flying object can thus be guided in the direction toward a target located in a three-dimensional space.

Figure 11C:
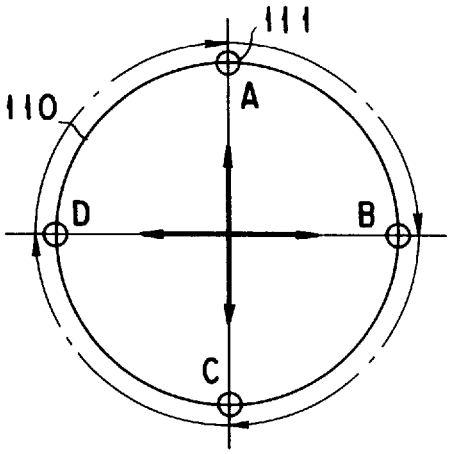

FIG. 11C shows the case including a single photo-detector. In this case, the single photo-detector 111 is arranged around the body 110 and rotated by 90° at a time. Then, four observation points A, B, C, D can be realized. Consequently, offset signals in two directions can be produced whereby it is possible to determine the steering vector for guiding the flying object.

Figure 11D:
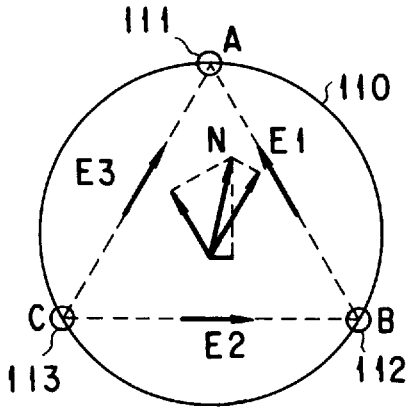
Figure 11E:
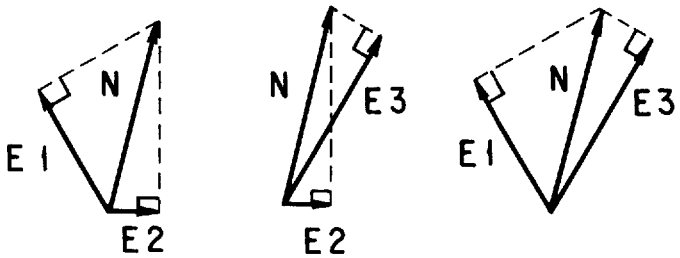

FIG. 11D, on the other hand, shows the case in which three photo-detectors are included. Specifically, in FIG. 11D, assume that three photo-detectors 111, 112, 113 are located at points A, B, C, respectively. An offset signal E1 along the direction A-B is produced from the photo-detectors 111, 112 at points A, B, an offset signal E2 along the direction B-C is produced from the photo-detectors 112, 113 at points B, C and an offset signal E3 along the direction C-A is produced from the photo-detectors 113, 111 located points C, A, respectively, as an error signal. The vector calculation as shown in FIG. 11E is performed using these three offset signals E1, E2, E3 thereby to produce a steering vector N.

As described above, according to this invention, once offset signals are obtained in two or more directions with respect to the center axis, the steering vector N can be obtained even when the directions of the offset signals are not perpendicular to each other. The positions and numbers of the photo-detectors to be installed, therefore, can be arbitrarily determined.

In the embodiment shown in FIG. 9, the target setting sensor and the flying object setting sensor are configured independently of each other. Alternatively, the functions of these two sensors can be integrated into a single sensor with equal effect.

Also, instead of the offset angle used as an offset amount in the above-mentioned embodiments, an offset distance can be used as the offset amount in the case where photo-detectors are arranged at points to which the distance is measurable or at predetermined points.

Further, although the magnitude of the received light signal output from the photo-detector is expressed in voltage, other units such as current or power can alternatively be used for expressing the incident energy amount directly or indirectly.

Now, a flying object guiding system according to a still further embodiment of the invention will be explained with reference to FIGS. 12A to 12H. The component parts identical to the corresponding ones in the above-mentioned embodiments are denoted by the same reference numerals, respectively, and will not be described again.

Figure 12A:
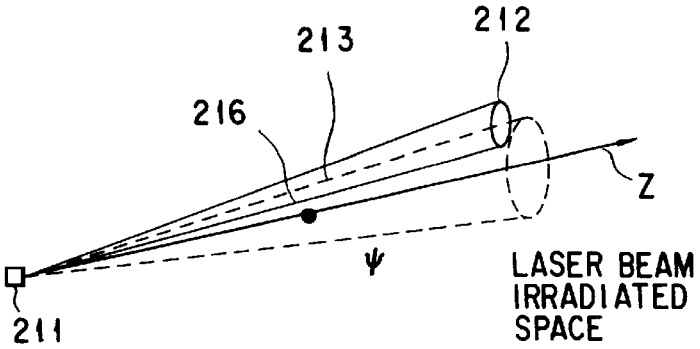
FIGS. 12A to 12H are diagrams for explaining light wave guiding systems according to other embodiments of the invention.
Figure 12B:
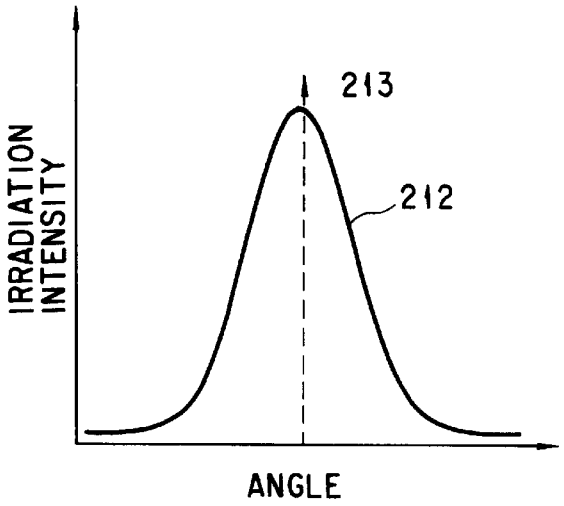

FIG. 12A shows the manner in which the conically-scanned laser beam is irradiated. The laser beam 212 emitted from the laser beam irradiator 211 has a maximum intensity in the direction at the beam orientation center 213 as shown in FIG. 12B and has such an intensity distribution that the irradiation intensity thereof is monotonically attenuated progressively according as it is offset from the beam orientation center. This laser beam 212 is rotated around the rotative axis Z in such a manner that the laser beam always has a predetermined eccentric angle $\phi$ from the center axis of the scanning rotation of the laser beam. At the same time, an irradiation space is formed with a conical beam orientation center 213 of the laser beam 212.

Figure 12C:
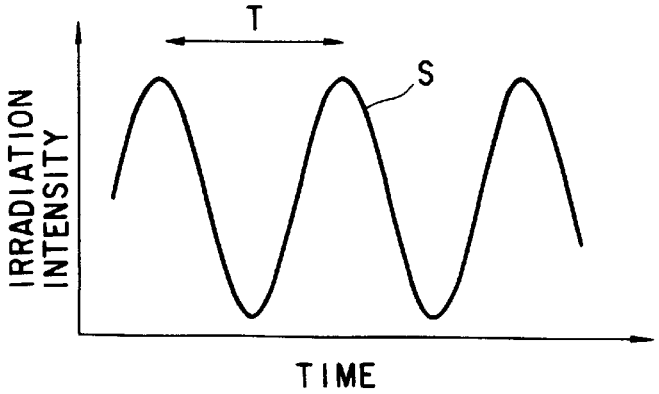

As long as the photo-detector 216 is located in the space, the received light signal S from the photo-detector 216 is a periodical signal S having the same period T as the scanning rotation of the laser beam 212 as shown in FIG. 12C unless the photo-detector 216 is located on the center axis Z of the rotative scanning of the laser beam. The photo-detector 216 is for converting the received light energy into a received light signal such as a voltage signal.

Figure 12D:
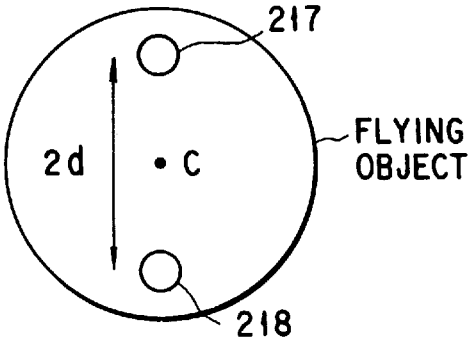

According to the above-mentioned operating principle, the two photo-detectors 217, 218 are arranged 2*d* apart from each other on the rear part of the flying object as shown in FIG. 12D, for example, in this embodiment. The received light signals from the two photo-detectors 217, 218 are assumed to be S1 and S2, respectively. Also, assume that the middle point between the two sensors 217, 218 is designated as C.

In this way, as far as the flying object carrying the photo-detectors 217, 218 is located in the laser beam irradiated space, the two photo-detectors 217, 218 detect a periodical signal conforming with the respective positions.

Figure 12E:
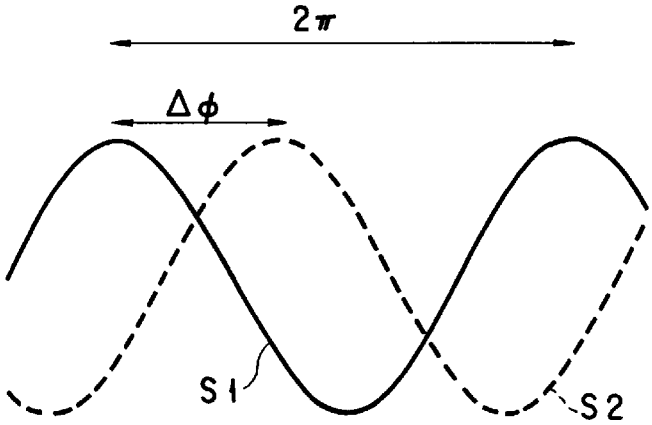

Assume that the phase difference between the signals S1, S2 from the two sensors 217, 218 is $\Delta\phi$. The phase difference between S1 and S3 represents the time lag from a local maximum value of S1 to a local maximum value of S2 in a standardization with the laser beam rotative period as $2\pi$, as shown in FIG. 12E.

Figure 12H:
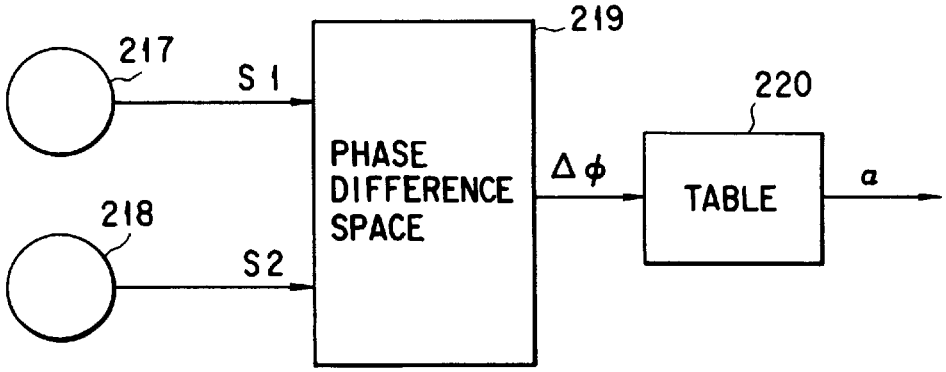

An explanation will be given of the relation between the middle point C of the sensors, the position of the rotative axis Z of laser beam scanning and the phase difference $\Delta\phi$ with reference to FIGS. 12F and 12G.

Figure 12F:
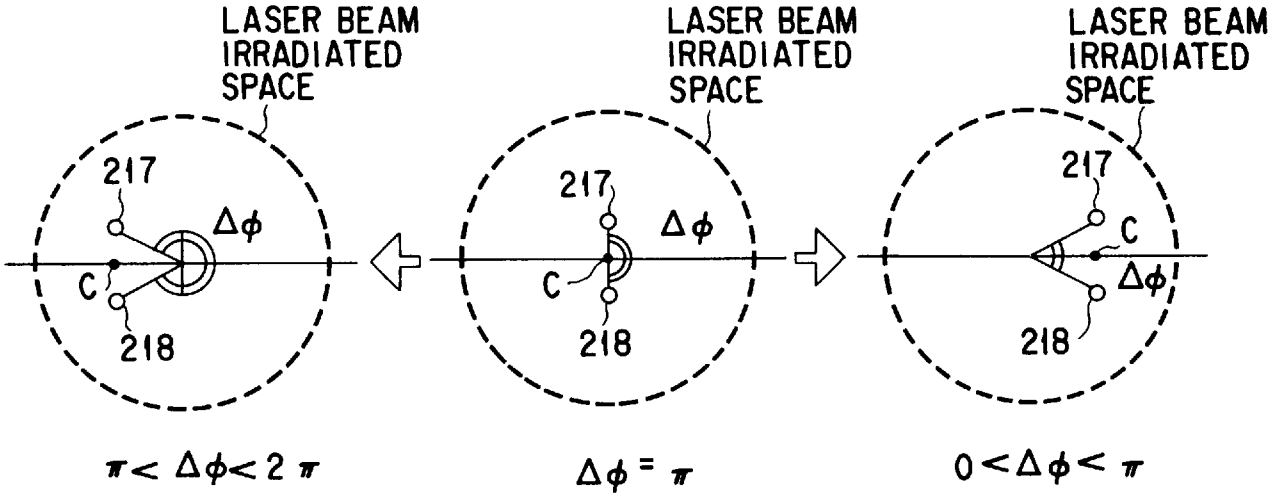
Figure 12G:
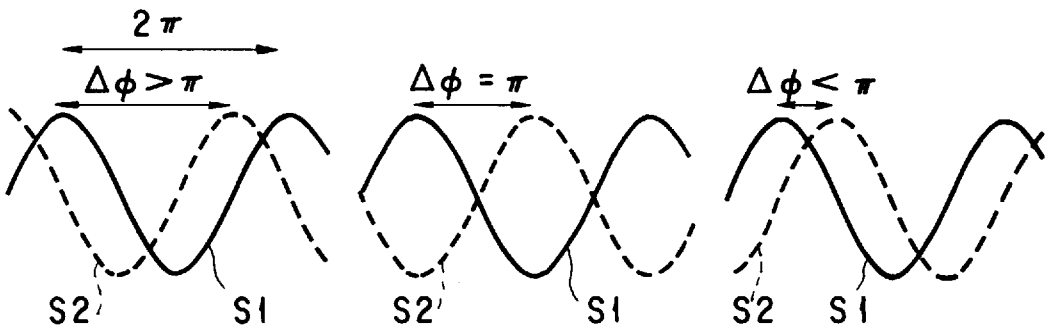

FIG. 12F is a view from the laser beam irradiator 211 toward the laser beam irradiated space. FIG. 12G shows an example of signals from the two corresponding photo-detectors 217, 218, respectively.

When the middle point C between the two photo-detectors 217, 218 is located at the center axis Z of the beam scanning rotation, the phase difference $\Delta\phi$ between S1 and S2 is $\pi$.

Assume that the middle point C is moved leftward along the perpendicular bisector of the two sensors 217, 218 while maintaining the distance between the photo detectors 217, 218. The phase difference $\Delta\phi$ holds the relation $\pi<\Delta\phi<2\pi$. In the case where the middle point C moves rightward along the perpendicular bisector of the two sensors 217, 218 in similar fashion, the phase difference $\Delta\phi$ meets the condition $0<\Delta\phi<\pi$.

The phase difference $\Delta\phi$ is equal to the angle that the position of each of the sensors 217, 218 forms with the rotative center axis Z. The positional relation between the middle point C of the sensors 217, 218, and therefore the laser rotative center axis Z is given by a function.

The position C is assumed to be (x, 0), and the distance between the sensor and C to be d. The relation between the phase difference $\Delta\phi$ and the offset movement x is given as $$x = \frac{d}{\tan\frac{\Delta\phi}{2}} \quad \text{where } \Delta\phi < \pi$$

$$x = 0 \quad \text{where } \Delta\phi = \pi$$

$$x = -\frac{d}{\tan\frac{\Delta\phi - \pi}{2}} \quad \text{where } \Delta\phi > \pi$$

The middle point C (x, 0) can thus be determined from the phase difference $\Delta\phi$. By moving the flying object in the direction in which the offset of the middle point C is absent, therefore, the middle point C can be guided onto the center axis Z of the laser scanning rotation.

FIG. 12H shows a configuration of an offset detection apparatus mounted on the flying object. In FIG. 12H, the signals S1, S2 produced from two photo-detectors 217, 218 are applied to a phase difference detector 219 for determining the phase difference $\Delta\phi$. The data on this phase difference $\Delta\phi$ is applied to a phase difference conversion table 220. The phase difference conversion table 220 has registered therein a function between the phase difference $\Delta\phi$ and an guide signal $\alpha$ for correcting the phase difference $\Delta\phi$ thereby to determine a guide signal a corresponding to the input phase difference $\Delta\phi$. This guide signal a is sent to a steering unit not shown and used for steering the flying object.

As clear from the foregoing description, an offset of a flying object moving along a single axis can be detected using two photo-detectors 217, 218 and thus a guide signal can be produced.

Figure 13A:
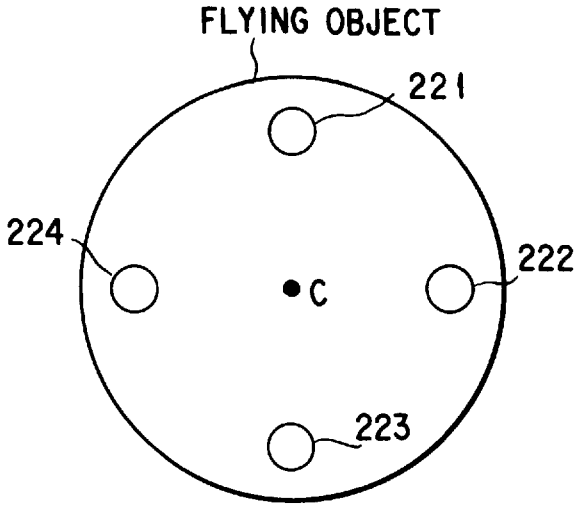
FIGS. 13A to 13D are diagrams for explaining light wave guiding systems according to other embodiments of the invention.

In the above-mentioned flying object guiding system according to these embodiments, the flying object can be guided over the entire range in the two-dimensional plane by adding one more axis. For example, assume that four photo-detectors 221 to 224 are arranged symmetrically with respect to each other about the center point C in the rear part of the flying object as shown in FIG. 13A and that the flying object is located in the laser beam irradiated space. Then, by using the signals S1 to S4 from the photo-detectors 221 to 224, the offset in the two-dimensional direction is obtained and thus the flying object can be guided in such a manner as to correct the particular offset.

Figure 13B:
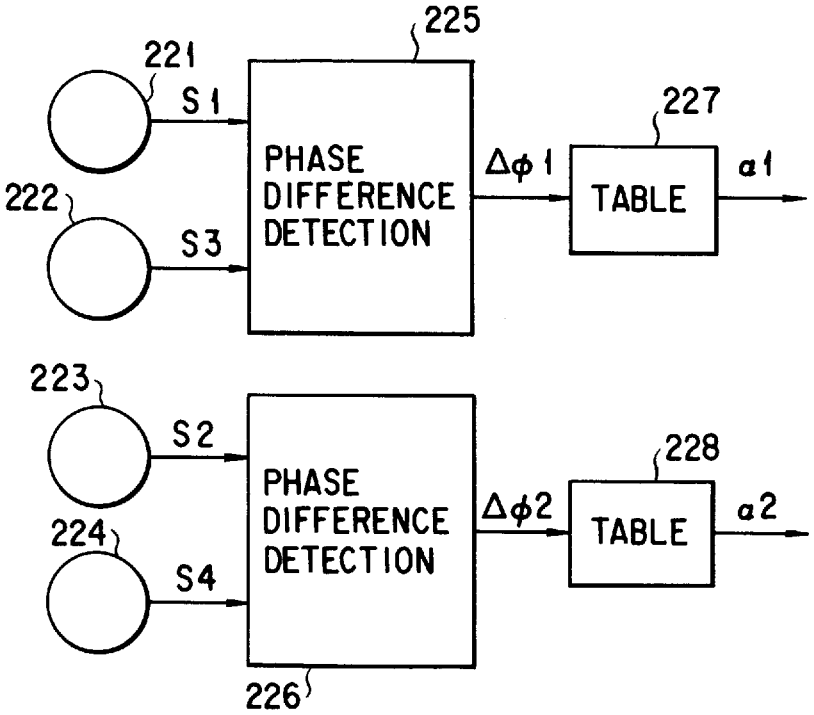

FIG. 13B shows a configuration of a flying object guiding system using the four photo-detectors 221 to 224. The signals S1 and S3 among the received light signals S1 to S4 obtained by the photo-detectors 221 to 224 are applied to a phase difference detector 225, and the signals S2, S4 are applied to a phase difference detector 226. The phase difference detector 225 detects the phase difference $\Delta\alpha 1$ between the signals S1 and S2, and the phase difference detector 226 detects the phase difference $\Delta\phi 2$ between the signals S2 and S4.

The phase differences $\Delta\phi 1$, $\Delta\phi 2$ are assumed to represent the time lag between a local maximum value of S1 and a local maximum value of S3 and the time lag between a local maximum value of S2 and a local maximum value of S4, respectively, in a standardization of the laser beam rotative period as $2\pi$. The phase differences $\Delta\phi 1$, $\Delta\phi 2$ obtained in the phase difference detectors 225, 226, respectively, are converted into guide signals $\alpha 1$, $\alpha 2$, respectively, by the phase difference conversion tables 227, 228, and sent to a steering unit not shown for use in guiding the flying object.

Figure 13C:
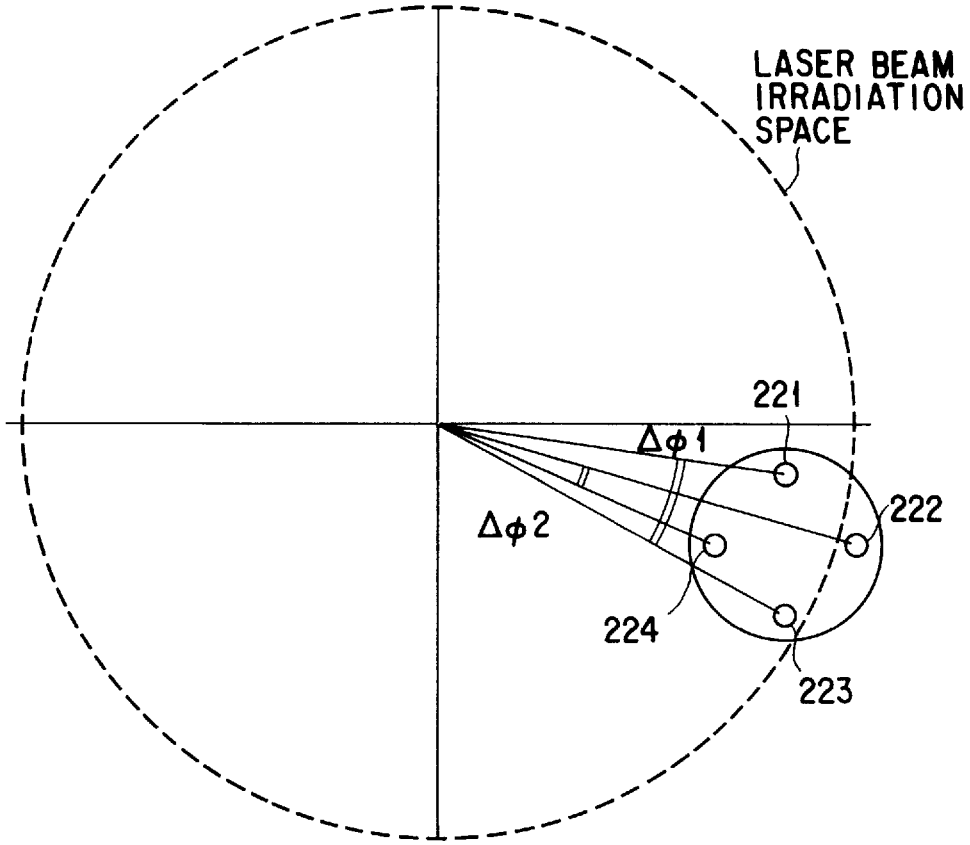
Figure 13D:
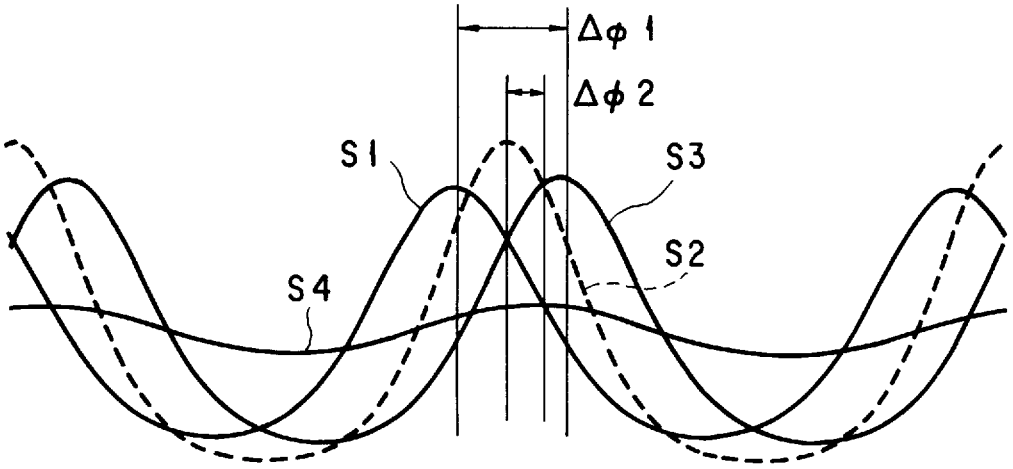

FIG. 13C shows the relation between the points in the space where the photo-detectors 221 to 224 are arranged and the phase differences, and FIG. 13D shows the received light signals S1 to S4 in that state. The use of the phase difference conversion tables 227, 228 makes it possible to determine the offset movement of an axis perpendicular to the axis connecting the photo-detectors 221 and 223 from the phase difference $\Delta\phi 1$, and the offset movement of an axis perpendicular to the axis connecting the photo-detectors 222 and 224 from the phase difference $\Delta\phi 2$. Thus it is possible to determine the guide signals $\alpha 1$, $\alpha 2$ for guiding the middle point C of the sensors to the center axis Z of laser beam rotative scanning.

As a result, guide signals can be obtained from the four received light signals for the movement of the flying object in a two-dimensional plane.

The foregoing description concerns the case using four photo-detectors. As far as three or more photo-detectors are not arranged on the same axis, however, the guidance in a two-dimensional plane is possible on the same principle.

In the above-mentioned embodiments, the use of CW (continuous wave) format is presupposed, and the laser beam is expressed as a continuous signal waveform as shown in FIG. 13D. Nevertheless, the invention can be easily realized also by a circuit included in the photo-detector of pulse modulation type for detecting the average value or the pulse wave crest value.

In the flying object guiding system according to this invention, an irradiated space capable of conically scanning the laser beam about the direction of guiding is formed by a guiding means, a periodical signal due to the conical scanning is detected by a plurality of photo-detectors mounted on the flying object, and the steering amount to the center of the irradiated space is calculated. These functions can provide means for transmitting from the guiding means the direction of movement of an flying object not sharing a coordinate system with the guiding means.

Especially, the flying object can be guided to a target without carrying any navigation calculator for sharing a coordinate system with the guiding means, and therefore the flying object can be reduced in size and weight.

Also, there is no need of mounting a seeker on a flying object for observing a target to which it is guided. Further, the reduced number of devices mounted can make a more slim body of the flying object for a reduced aerodynamic resistance. The result is an increased speed or a reduced fuel consumption.

As described above, according to the present invention, there can be realized an offset detection apparatus for detecting the amount or the direction of offset from a predetermined axis, and a light wave guiding apparatus capable of guiding a flying object in a predetermined direction even in the absence of a coordinate system shared with the guiding means.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalent.

We claim:

1. An offset detection apparatus comprising:

a laser beam irradiator for irradiating a laser beam having a maximum irradiation intensity in a predetermined orientation, said laser beam irradiator being configured such that the irradiation intensity thereof decreases with the increase of the distance from said orientation, said laser beam being irradiated while being conically rotated with said orientation inclined with respect to a predetermined axis;

a photo-detector located in an area irradiated by said laser beam from said laser beam irradiator for receiving said laser beam and outputting a received light signal corresponding to the irradiation intensity thereof;

memory means for converting the relation between an offset amount of said photo-detector with respect to a center axis of conical scanning of said laser beam and the received light signal corresponding to said offset amount into data and storing said data; and an offset amount detector for comparing said received light signal output from said photo-detector with said data stored in said memory means and detecting the offset amount of said photo-detector with respect to the center axis of conical scanning of said laser beam.

2. An offset detection apparatus comprising:

a laser beam irradiator for irradiating a laser beam having a maximum irradiation intensity in a predetermined orientation, said laser beam irradiator being configured such that the irradiation intensity thereof decreases with the increase in the distance from said orientation, said laser beam being irradiated while being conically rotated with said orientation inclined with respect to a predetermined axis;

a photo-detector located in an area irradiated by said laser beam from said laser beam irradiator for receiving said laser beam and outputting a received light signal corresponding to the irradiation intensity thereof;

memory means for converting the relation between an offset amount of said photo-detector with respect to a center axis of conical scanning of said laser beam and the ratio between a maximum value and a minimum value of said received light signal corresponding to said offset amount into data and storing said data; and an offset amount detector for comparing the ratio between the maximum value and the minimum value of said received light signal output from said photo-detector with said data stored in said memory means and detecting the offset amount of said photo-detector with respect to the center axis of the conical scanning of said laser beam.

3. An offset detection apparatus comprising:

a laser beam irradiator for irradiating a laser beam having a maximum irradiation intensity in a predetermined orientation, said laser beam irradiator being configured such that the irradiation intensity thereof decreases with the increase in the distance from said orientation, said laser beam being irradiated while being conically rotated with said orientation inclined with respect to a predetermined axis;

two photo-detectors arranged at a predetermined interval in such a manner that a straight line connecting said two photo-detectors is perpendicular to a center axis of conical scanning of said laser beam in an area irradiated by said laser beam irradiator, said photo-detectors being adapted to receive said laser beam and produce received light signals corresponding to the irradiation intensity thereof;

two amplitude detection means for detecting the amplitude change of the received light signals output from said two photo-detectors, respectively; and an offset direction detector for comparing the magnitude of the amplitude change detected by said two amplitude detection means with each other and detecting the direction of offset of said two photo-detectors with respect to the center axis of conical scanning of said laser beam.

4. An offset detection apparatus comprising:

a laser beam irradiator for irradiating a laser beam having a maximum irradiation intensity in a predetermined orientation, said laser beam irradiator being configured such that the irradiation intensity thereof decreases with the increase in the distance from said orientation, said laser beam being irradiated while being conically rotated with said orientation inclined with respect to a predetermined axis;

two photo-detectors arranged at a predetermined interval in such a manner that a straight line connecting said two photo-detectors is perpendicular to a center axis of conical scanning of said laser beam in an area irradiated by said laser beam from said laser beam irradiator, said photo-detectors being adapted to receive said laser beam and produce received light signals corresponding to the irradiation intensity thereof;

two amplitude ratio detection means for detecting the ratio between a maximum amplitude value and a minimum amplitude value of the received light signals output from said two photo-detectors, respectively; and an offset direction detector for comparing the magnitude of the amplitude ratio detected by said two amplitude ratio detection means with each other and detecting the direction of offset of said two photodetectors with respect to the center axis of conical scanning of said laser beam.

5. An offset detection apparatus comprising:

a laser beam irradiator for irradiating a laser beam having a maximum irradiation intensity in a predetermined orientation, said laser beam irradiator being configured such that the irradiation intensity thereof decreases with the increase in the distance from said orientation, said laser beam being irradiated while being conically rotated with said orientation inclined with respect to a predetermined axis;

a plurality of photo-detectors arranged at predetermined intervals in an area irradiated by said laser beam from said laser beam irradiator and adapted to receive said laser beam and produce received light signals corresponding to the irradiation intensity thereof; and offset detection means for determining an amount and a direction of offset of each two of said photo-detectors on a single axis with respect to a center axis of conical scanning of said laser beam on the basis of said received light signals, and determining a combined offset amount and offset direction.

6. A flying object guiding system for guiding a flying object toward a target by an external guiding means located outside said flying object, comprising:

an external guiding means including a laser beam irradiator for irradiating a laser beam having a maximum irradiation intensity in a predetermined orientation with the irradiation intensity progressively decreasing away from said orientation, and a direction controller for directing a center axis of conical scanning of said laser beam irradiated by said laser beam irradiator toward said target, said laser beam being irradiated while being conically rotated with said orientation inclined with respect to a predetermined axis; and an internal, guiding means inside said flying object, including a plurality of photo-detectors for receiving said laser beam from said laser beam irradiator and producing received light signals corresponding to the irradiation intensity thereof, offset detectors for comparing the received light signals output from each two of a plurality of said photo-detectors with each other and determining an amount and a direction of offset of said two photo-detectors with respect to said predetermined axis, calculation means for calculating the amount of steering and the direction of steering said flying object from said offset amount and said offset direction determined by said offset detectors, and means for controlling the steering operation of said flying object on the basis of said steering amount and said steering direction calculated by said calculation means.

7. A flying object guiding system according to claim 6, wherein said external guiding means comprises:

a target setting sensor for detecting the position of the target toward which said flying object is intended to be guided; and an irradiation direction calculator for calculating an irradiated area of said laser beam of said laser beam irradiator in such a manner that said target is included in said irradiated area on the basis of the position of said target detected by said target setting sensor;

wherein said direction controller controls the direction of irradiation of said laser beam irradiator on the basis of the result of calculation of said irradiation direction calculator.

8. A flying object guiding system according to claim 6, wherein said external guiding means comprises:

a flying object setting sensor for detecting the position of said flying object; and an irradiation direction calculator for calculating the irradiated area of said laser-beam irradiator in such a manner that said flying object is included in said laserbeam irradiated area on the basis of the position of said flying object detected by said flying object setting sensor;

wherein said direction controller controls the direction of irradiation of said laser beam irradiator on the basis of the result of the calculation by said irradiation direction calculator.

9. A flying object guiding system according to claim 6, wherein said external guiding means comprises:

a target setting sensor for detecting the position of the target toward which said flying object is intended to be guided;

a flying object setting sensor for detecting the position of said flying object; and an irradiation direction calculator for calculating the irradiated area of said laser beam irradiator in such a manner that said flying object and said target are included in said irradiated area on the basis of the position of said target detected by said target setting sensor and the position of said flying object detected by said flying object setting sensor;

wherein said direction controller controls the direction of irradiation by said laser beam irradiator on the basis of the result of the calculation by said irradiation direction calculator.

10. A flying object guiding system for guiding a flying object toward a target from an external guiding means outside said flying object, comprising:

an external guiding means including a laser beam irradiator for irradiating a laser beam having a maximum irradiation intensity in a predetermined orientation, said laser beam irradiator being configured to be rotated conically with said orientation inclined with respect to a predetermined axis, and a direction controller for directing said predetermined axis of said laser beam toward said target; and an internal guiding means of said flying object, including a photo-detector for receiving said laser beam irradiated by said laser beam irradiator and outputting a received light signal corresponding to the irradiation intensity of said laser beam, said photo-detector having a changing light-receiving position, an offset detector for determining the amount and the direction of offset of said photo-detector with respect to a center axis of conical scanning of said laser beam on the basis of the received light signal output from said photo-detector having a different light-receiving position, calculation means for calculating a steering amount and a steering direction of said flying object from said offset amount and said offset direction determined by said offset detector, and means for steering said flying object according to said steering amount and said steering direction calculated by said calculation means.

11. A flying object guiding system according to claim 10, further comprising:

a plurality of photo-detectors arranged at predetermined intervals for receiving said laser beam from said laser beam irradiator and outputting a received light signal corresponding to the irradiation intensity thereof in the same manner as said photo-detectors, said photo-detectors having a changing light-receiving position.

12. An offset detection apparatus comprising:

a laser beam irradiator for irradiating a laser beam having a maximum irradiation intensity in a predetermined orientation, said laser beam irradiator being configured such that the irradiation intensity thereof decreases with the increase in the distance from said orientation, said laser beam being irradiated while being conically rotated with said orientation inclined with respect to a predetermined axis;

two photo-detectors arranged at predetermined intervals in such a manner that a straight line connecting said two photo-detectors is perpendicular to a predetermined axis in a laser-beam irradiated area of said laser beam irradiator, said photo-detectors being adapted to receive said laser beam and produce received light signals corresponding to the irradiation intensity thereof;

a phase difference detector for detecting a phase difference between the received light signals output from said two photo-detectors, respectively; and offset direction detection means for comparing the magnitudes of the phase difference detected by said phase difference detector thereby to detect a direction of offset of said two photo-detectors with respect to said predetermined axis.

13. A flying object guiding system for guiding a flying object toward a target from an external guiding means outside said flying object, comprising:

an external guiding means including a laser beam irradiator for irradiating a laser beam having a maximum irradiation intensity in a predetermined orientation and having such that the irradiation intensity thereof decreasing away from said orientation, and a direction controller for directing a predetermined axis of said laser beam irradiator toward said target; and an internal guiding means for said flying object, including two photo-detectors for receiving said laser beam irradiated by said laser beam irradiator and outputting a received light signal corresponding to the irradiation intensity of said laser beam, a phase difference detector for detecting a phase difference between the received light signals output from said two photo-detectors, respectively, offset direction detection means for detecting a direction of offset of said two photo-detectors with respect to a center axis of conical scanning of said laser beam on the basis of the phase difference detected by said phase difference detector, calculation means for calculating a steering amount and a steering direction of said flying object from said offset direction detected by said offset direction detection means, and means for controlling the steering of said flying object according to the result of said calculation.

14. A flying object guiding system according to claim 13, wherein said offset direction detection means comprises:

a conversion table for determining a one-dimensional relative positions of a middle point between said photo-detectors and the center axis of conical scanning of said laser beam on the basis of the phase difference between the signals produced from said phase difference detector.

15. A flying object guiding system according to claim 14, wherein the middle point between said photodetectors is guided to said center axis of conical scanning of said laser beam by a mechanical operation based on the one-dimensional relative position determined by said conversion table.

16. A flying object guiding system for guiding a flying object toward a target by an external guiding means outside said flying object, comprising:

an external guiding means including a laser beam irradiator for irradiating a laser beam having a maximum irradiation intensity decreasing with an increase in the distance from said orientation, and a direction controller for positioning said predetermined axis of said laser beam irradiator in a direction toward said target; and an internal guiding means including at least three photo-detectors aligned for receiving said laser beam from said laser beam irradiator and outputting a received light signal corresponding to the irradiation intensity of said laser beam, a plurality of phase difference detectors for detecting a phase difference between the outputs of said at least three photo-detectors, and conversion tables for determining two-dimensional relative positions of a middle point between said photo-detectors and a center axis of conical scanning of said laser beam using at least two phase differences obtained from said at least three photo-detectors;

wherein the steering amount and the steering direction of said flying object for guiding said middle point between said photo-detectors to said center axis of conical scanning of said laser beam on the basis of said two-dimensional relative positions determined from said conversion tables, and the steering operation of said flying object is controlled on the basis of the result of said calculation.

* * * * *